US005427185A

United States Patent [19]

Seal

[11] Patent Number: 5,427,185

[45] Date of Patent: Jun. 27, 1995

[54] DITCHER

[76] Inventor: James C. Seal, 9190 Dummyline Rd., Picayune, Miss. 39466

[21] Appl. No.: 92,992

[22] Filed: Jul. 19, 1993

[51] Int. Cl.[6] ..... E02F 3/815

[52] U.S. Cl. ..... 172/684.5; 172/445.2; 172/197; 404/118

[58] Field of Search ..... 172/40, 47, 78, 140, 172/161, 176, 197, 785, 786, 892, 795, 796, 6894.5, 445.1, 445.2, 788, 799.5; 404/118

[56] References Cited

U.S. PATENT DOCUMENTS

| | | | |
|---|---|---|---|
| 2,994,142 | 8/1961 | Newell et al. | 172/445.1 |
| 3,542,136 | 11/1970 | Coontz | 172/445.2 |
| 4,244,662 | 1/1981 | Olson | 404/118 |
| 4,506,741 | 3/1985 | Hula, Jr. | 172/445.1 |
| 4,529,041 | 7/1985 | Black | 172/445.1 |
| 4,614,240 | 9/1986 | Miller | 172/799.5 |
| 4,802,293 | 2/1989 | Smith | 172/799.5 |
| 4,821,810 | 4/1989 | Buchanan | 172/197 |
| 4,898,247 | 2/1990 | Springfield | 172/799.5 |

*Primary Examiner*—Randolph A. Reese
*Assistant Examiner*—Robert Pezzuto
*Attorney, Agent, or Firm*—Jacobson, Price, Holman & Stern

[57] ABSTRACT

Earth working apparatuses and more specifically a ditcher or slope cutting device adapted to be connected with a conventional three point hitch mounted at the rear of a conventional tractor. The earth working apparatus includes a rigid square or rectangular frame having pairs of pivot lugs spaced laterally on a front member thereof for pivotal connection to the lower links or arms of a three point hitch and a pair of centrally located upwardly disposed pivot lugs pivotally supporting an upright member having its upper end connected to the upper link or arm of the three point hitch. A hydraulic ram or mechanical structure interconnects the frame at a point spaced rearwardly from the front and an upper end portion of the upwardly extending member in order to adjust the angular relation between the frame and the upwardly extending member and angularly adjust the frame in relation to the three point hitch and in relation to the ground surface. The frame includes one or more ground engaging blades which are supported from the frame for adjustable rotatable or pivotal movement in relation to the frame and ground surface, by a hydraulic ram or mechanical structure, about an axis that is perpendicular to the frame thereby enabling adjustment of the plane of contact with the ground surface to be varied as to its angle of inclination due to the capability of varying the angular relation of the frame to the ground surface and the change in angular disposition of the blade or blades in relation to the frame about an axis perpendicular to the frame.

4 Claims, 4 Drawing Sheets

DITCHER

BACKGROUND OF THE INVENTION

1. Field of the Invention

The present invention generally relates to earth working apparatuses and more specifically to a ditcher or slope cutting device adapted to be connected with a conventional three point hitch mounted at the rear of a conventional tractor. The earth working apparatus includes a rigid square or rectangular frame having pairs of pivot lugs spaced laterally on a front member thereof for pivotal connection to the lower links or arms of a three point hitch and a pair of centrally located upwardly disposed pivot lugs pivotally supporting an upright member having its upper end connected to the upper link or arm of the three point hitch. A hydraulic ram interconnects the frame at a point spaced rearwardly from the front and an upper end portion of the upwardly extending member in order to adjust the angular relation between the frame and the upwardly extending member and angularly adjust the frame in relation to the three point hitch and in relation to the ground surface. The frame includes one or more ground engaging blades which are supported from the frame for adjustable rotatable or pivotal movement in relation to the frame and ground surface about an axis that is perpendicular to the frame thereby enabling the plane of contact with the ground surface to be adjusted as to its angle of inclination due to the capability of varying the angular relation of the frame to the ground surface and variation in the angular disposition of the blade or blades in relation to the frame about an axis perpendicular to the frame. The frame may have various attachments supported therefrom including a scarifier, chisel plows, various other types of plow devices or points, tillers, cultivators, spring tooth harrows, discs, rotating tillers and may have additional frames or attachments and associated earth working apparatuses articulately connected to the frame with all of the earth working apparatuses being controlled remotely by hydraulic and/or manual control devices.

2. Description of the Prior Art

As is well known, motor graders, sloping devices and the like have been used for forming ditches and otherwise grading or sloping the soil surface. Such devices usually include an elongated frame having rear driving wheels and a cab with operator controls and front steerable wheels with a grader blade supported centrally of the elongated frame in which the grader blade can be adjusted substantially universally in relation to the soil surface to be graded. However, since the blade is positioned generally centrally of the elongated frame, the blade cannot be used to grade or slope surfaces which cannot be accessed due to the front or rear wheels becoming associated with some type of obstruction such as a fence, building wall, culvert or bridge, tree or the like. Other devices for use in earth working for attachment to a three point hitch are illustrated in the following U.S. Pat. Nos.:

4,320,988
4,572,301
4,655,297
5,191,943

None of the prior art discloses the concept of utilizing a rigid frame attached to the three point hitch of a tractor for lifting and lowering the same combined with a structure for pivoting and adjusting the frame about a transverse axis in relation to the three point hitch and providing various blade arrangements supported from the frame with all components being adjusted by hydraulic ram structures or mechanical structures with either type of structure being manually or remotely operated to also pivot the blades about an axis perpendicular to the frame. The blade arrangements include a single elongated traverse blade supported generally centrally of the frame and pivoted about a central vertical axis, a single elongated blade with one or two forwardly or rearwardly mounted wing blades at the corners of the frame and each pivoted about a central vertical axis, wing blades only at the front or rear of the frame and wing blades at the front and elongated blades at the rear all of which can be adjusted about a central axis perpendicular to the frame by hydraulic rams or mechanically with linkage assemblies which can be operated manually or remotely.

SUMMARY OF THE INVENTION

An object of the present invention is to provide a ditcher or slope cutting or forming device attached to, supported from and movable with a conventional three point hitch at the rear of a tractor with the structure of the device including a rigid frame supporting one or a plurality of transversely extending blades supported from the frame for pivotal movement about an axis or axes perpendicular to the frame with the blade or blades being angularly adjusted by the use of hydraulic rams powered from the hydraulic system of the tractor and controlled by the tractor operator.

Another object of the invention is to provide a ditcher in accordance with the preceding objects in which the frame is of generally rigid rectangular or square configuration including a peripheral beam structure and intermediate beams all oriented in substantially the same plane with the interior corners of the frame including gusset plates constructed in a manner to receive bearing assemblies and a supporting shaft or axle for corner blades with a central portion of the frame also including a bearing structure for receiving a shaft or axle of an elongated transverse blade which enables selective orientation of blades or the mounting of a single blade from the frame to enable effective earth working operations to be performed such as ditching, forming sloping surfaces on levees and various other earth working operations inasmuch as the frame also is capable of supporting other earth working tools such as tillers, scarifiers, cultivators, discs, plows and the like.

A further object of the invention is to provide a ditcher with a rigid frame as set forth previously in which a hydraulic ram structure interconnects an upper end portion of the three point hitch and the frame rearwardly of a transverse pivotal connection between the frame and the three point hitch in order to orient the frame in various inclined positions with respect to horizontal which combined with the pivotal movement of a blade or blades mounted on the frame enabling the working edge of the blade to be oriented in various angular positions with respect to the transverse axis of the pivotal connection between the frame and the three point hitch and an axis perpendicular to the frame with the axis about which a blade is adjusted being adjusted angularly with the frame to enable the cutting edge of the blade to be oriented in a desired angular relation with respect to the ground surface.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 5:
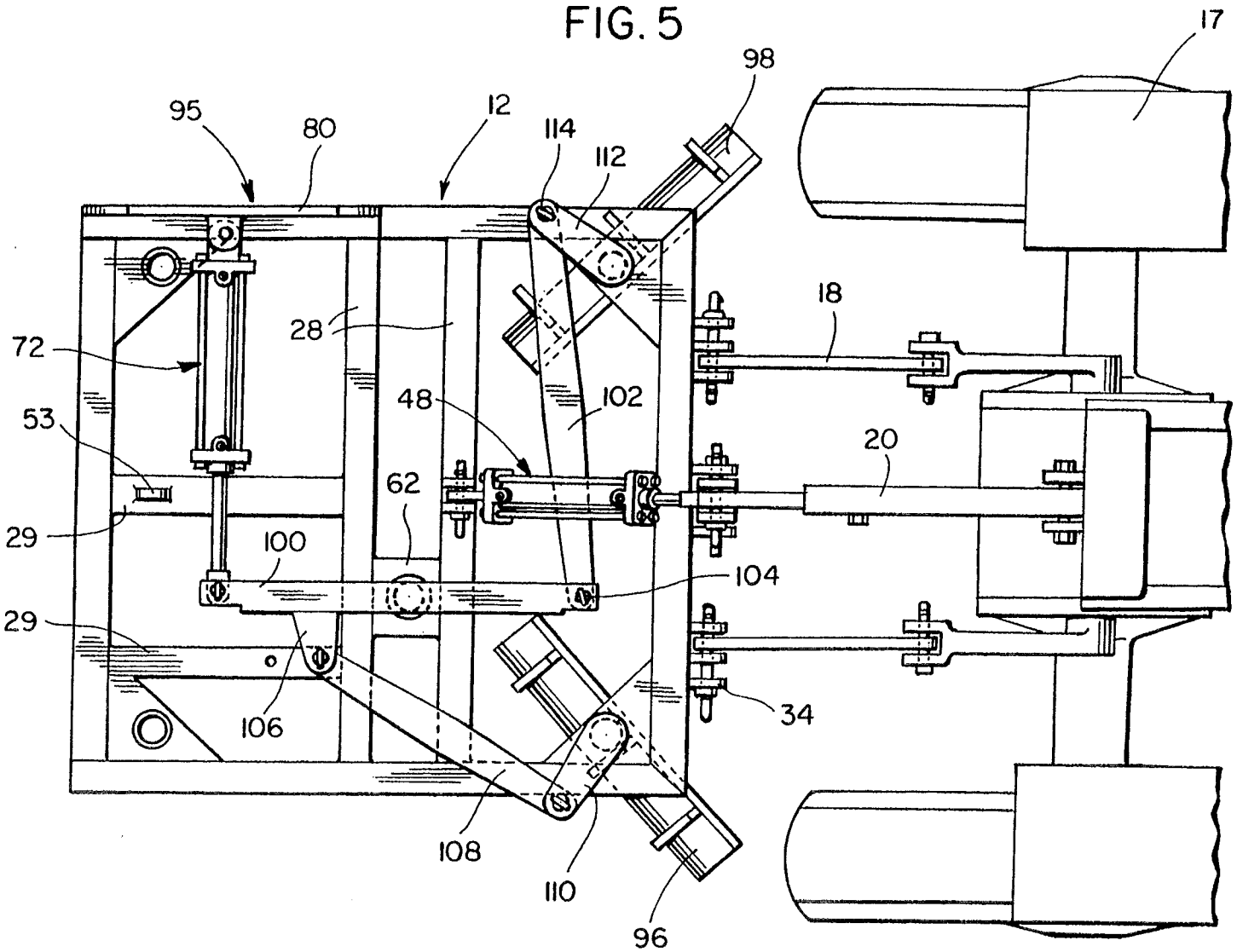
FIG. 5 is a plan view illustrating another arrangement of blades with respect to the frame in which two relatively short forwardly mounted wing blades are provided.
Figure 6:
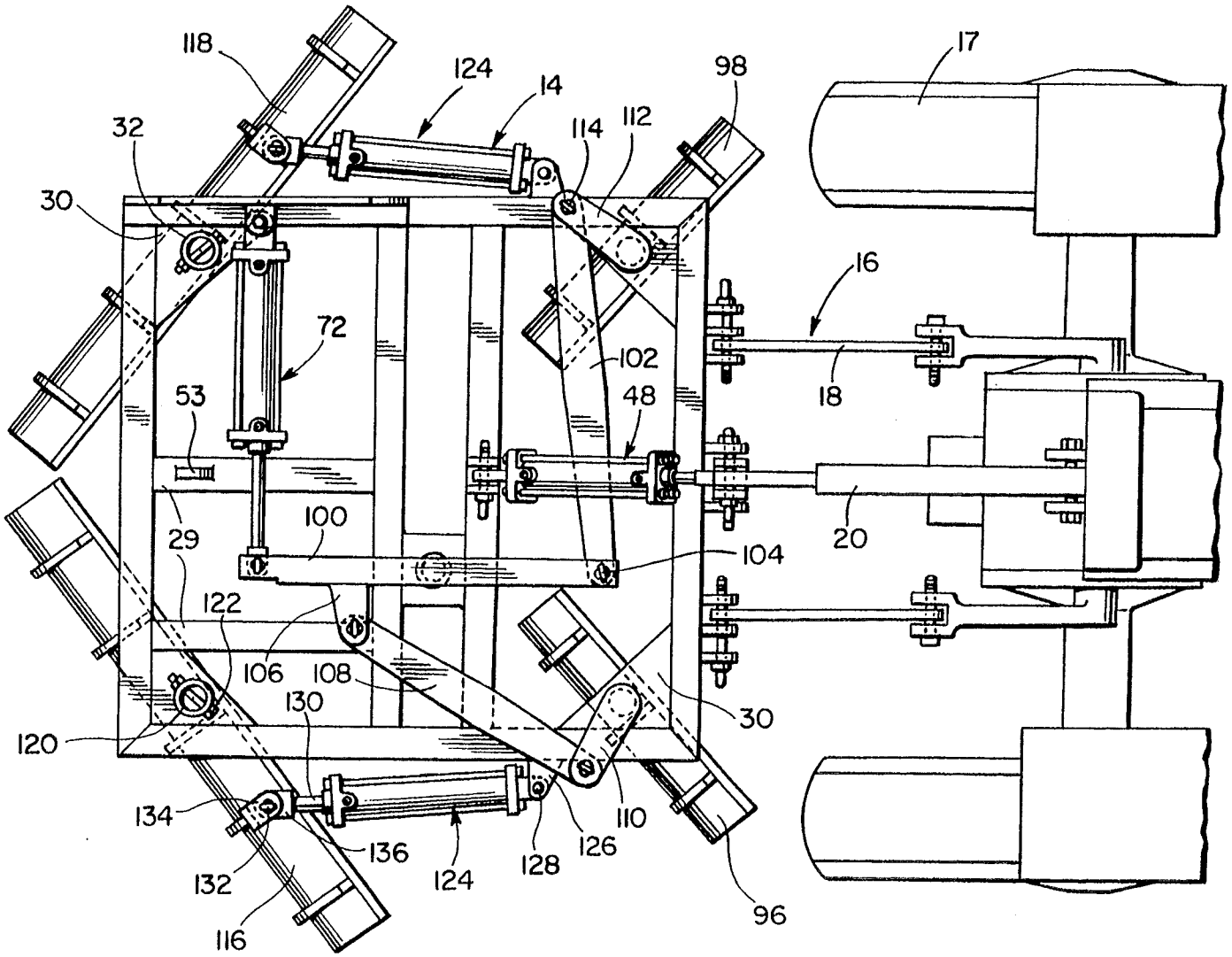
FIG. 6 is a plan view illustrating another embodiment of the frame and blades in which two forward wing blades are provided and two rear blades of elongated configuration are provided on the frame.

Referring now specifically to the drawings, the ditcher illustrated in FIGS. 1–4 is generally designated by reference numeral 10, the ditcher assembly illustrated in FIG. 5 is generally designated by reference 12 and the ditcher assembly illustrated in FIG. 6 is generally designated by reference numeral 14 with each embodiment of the invention adapted to be supported from the three point hitch assembly 16 of a conventional tractor 17 with the three point hitch including the usually provided bottom arms or links 18 and a top link or arm 20 connected with the tractor and the tractor lift mechanism in a conventional and well known manner.

Figure 1:
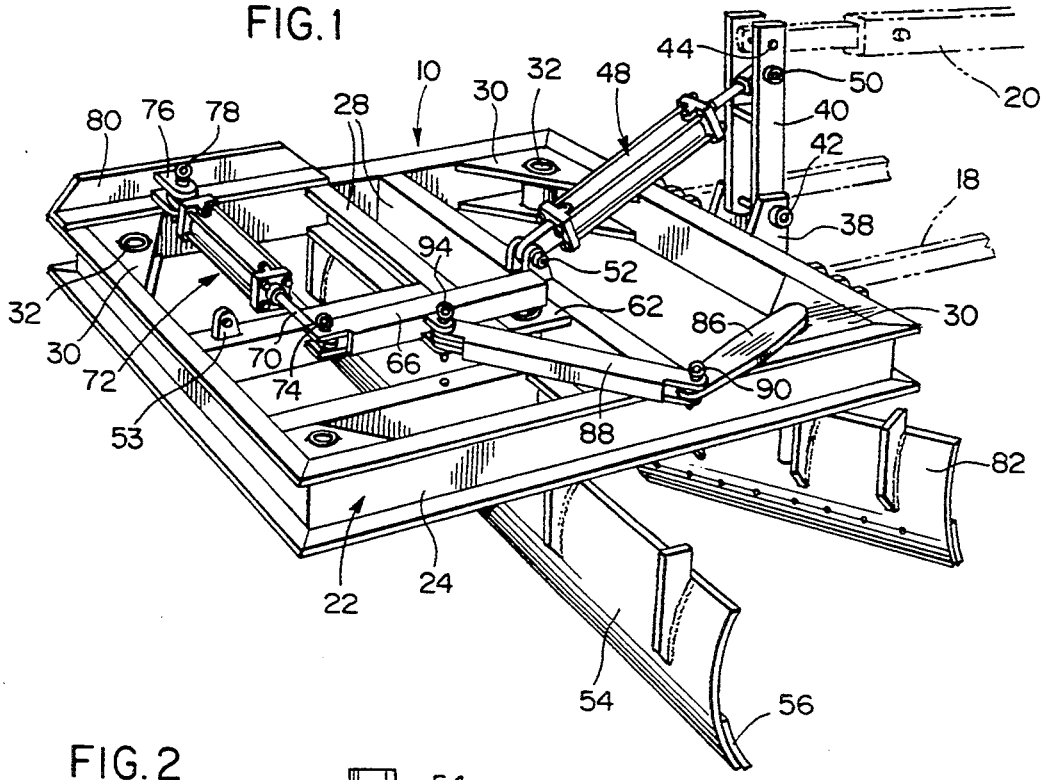
FIG. 1 is a perspective view of the present invention illustrating the structure of the frame, a single elongated transverse blade mounted thereon and an optional shorter wing blade mounted forwardly and adjacent one end of the elongated blade.
Figure 2:
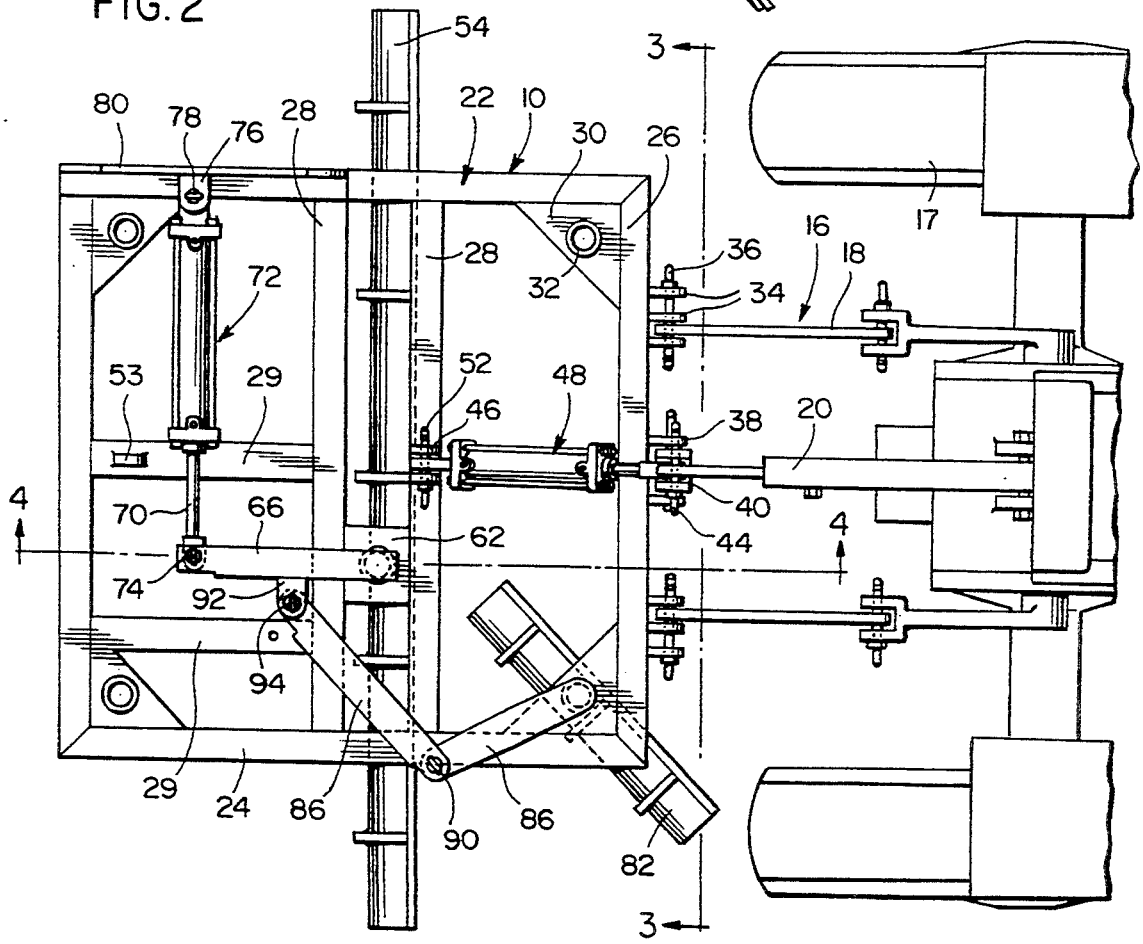
FIG. 2 is a top plan view of the construction of FIG. 1.

Referring now specifically to FIGS. 1–4, the ditcher 10 includes a rigid, substantially square or rectangular frame 22 including side beams 24, front and rear beams 26, intermediate transverse beams 28 and intermediate longitudinal beams 29 oriented in the manner illustrated in FIG. 2 with all of the beams preferably being of channel shaped configuration although other structural configurations can be used. The beams are rigidly connected to each other and the inside corners of the frame 22 are provided with reinforcing and rigidifying gussets 30 with the gussets in each corner being welded to the beams and provided with a centrally disposed tubular sleeve 32. The front beam 26 of the frame includes two groups of forwardly spaced pivot lugs 34 forming a clevis receiving a clevis pin 36 which extends through the lugs 34 and the associated end portion of the lower arms or links 18. As illustrated three lugs are provided in each group to enable the frame to be connected to three point hitch assemblies that may have different spacing arrangements between the lower arms or links 18. Also, the central portion of the front beam is provided with a pair of upwardly extending relatively short lugs 38 fixedly attached thereto for pivotally supporting an upstanding member 40 that is pivotally connected thereto by a pivot pin or bolt 42 with the upper end of the member 40 being connected to the upper link or arm 20 by a pivot pin or bolt 44.

Extending between the upper end portion of the upstanding member 40 and a pair of pivot lugs 46 on a transverse beam 28 is a hydraulic ram assembly 48 pivotally connected to the upstanding member 40 by a pivot pin or bolt 50 and pivotally connected to the lugs 46 by a pivot bolt or pin 52. Thus, with this construction, the frame 10 may be lifted and lowered by actuation of the three point hitch assembly 16 in a conventional and well known manner thereby enabling the ditcher to be adjusted upwardly or downwardly by the tractor operator operating controls for the three point hitch assembly in a well known and conventional manner. Also, the hydraulic ram 48 is controlled by the tractor operator and powered from the hydraulic system of the tractor which enables the frame 10 to be pivoted about the transverse axis adjacent the forward edge of the frame and just above the frame as indicated by the pivot pin or bolt 42 with the pivotal movement of the frame about the transverse axis being controlled by the hydraulic ram 48. The centrally located partial longitudinal beam 29 is provided with a rigid upstanding lug 53 by which tandem attachments may be connected to the ditcher 10 such as a roller, trailer, planter or the like.

Mounted transversely of the frame 22 is a transversely elongated blade 54 which is curved in cross sectional configuration with the convex surface facing forwardly and provided with a conventional removable plate 56 forming the cutting edge for the blade. The central part of the blade 54 is provided with a vertical shaft or axle 58 rigidly connected to the blade 54 as by welding or the like with the shaft or axle 58 extending through a vertically disposed bearing sleeve 60 rigidly secured between the beams 28 by mounting gussets 62. The upper end of the shaft or axle 58 extends above the sleeve 50 and a collar 64 is rigid affixed to the shaft or axle below the bearing sleeve 60 to prevent and limit upward movement of the axle or shaft in the sleeve. The upper end of the shaft or axle 58 is rigidly connected to a channel shaped arm 66 with a bearing spacer 68 between the bottom surface of the arm 66 and the upper end of the sleeve 60 which combines with the collar 64 to enable swivelling movement of the shaft or axle and blade 54 with the collar 64 and arm 66 preventing vertically displacement of the shaft or axle 58 in relation to the frame. The arm 66 is rigidly affixed to the upper end of the shaft or axle and the other end of the arm 66 is pivotally connected to the piston rod 70 of a hydraulic ram assembly 72 by a pivot pin or bolt 74. The hydraulic ram assembly 72 is transversely disposed in relation to the frame with the other end of the ram assembly being attached to lugs 76 by a pivot pin or bolt 78 with the lugs 76 being rigidly affixed to an upwardly extending plate 80 affixed to the side rail 24 as illustrated in FIGS. 1–4.

In one embodiment of the invention, the frame 22 is provided with only the elongated centrally disposed, transversely extending blade 54 with the angular position of the blade 54 in relation to the frame 22 being adjusted about the axis of the bearing sleeve 60 and shaft or axle 58 which is perpendicular to the plane of the frame 22. In addition, the frame 22 is adjusted about a transverse axis defined by the pivot pin or bolt 42 by expanding and contracting the hydraulic ram which may be a single acting or double acting ram with the ram 72 also being a double acting ram in order to pivot the blade 54 to the desired position. The entire ditcher may be adjusted by actuating the three point hitch assembly in order to raise and lower the ditcher to a desired elevation depending upon the use requirements. By varying the elevational position of the ditcher and varying the angular position of the frame about a transverse axis and varying the angular position of the blade about an axis perpendicular to the frame, the angular orientation of the cutting edge of the blade 54 can be varied to perform a ditching operation, sloping operation or various other earth working operations requiring universal positioning of the blade. This structure provides a relatively simple structure but yet one which enables accurate orientation of the cutting blade at a minimum of cost since the device can be easily manufactured and quickly and easily attached to and detached from a conventional three point hitch.

Figure 3:
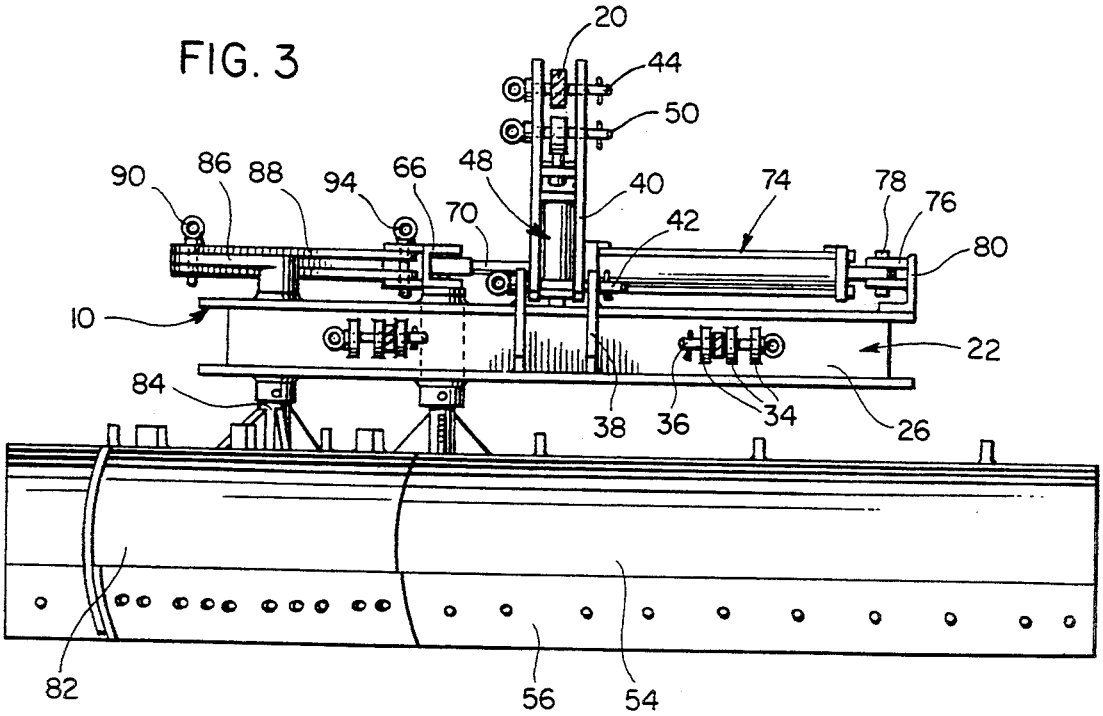
FIG. 3 is a front elevational view of the ditcher taken along section line 3—3 on FIG. 2 illustrating the relationship of the frame and blades.
Figure 4:
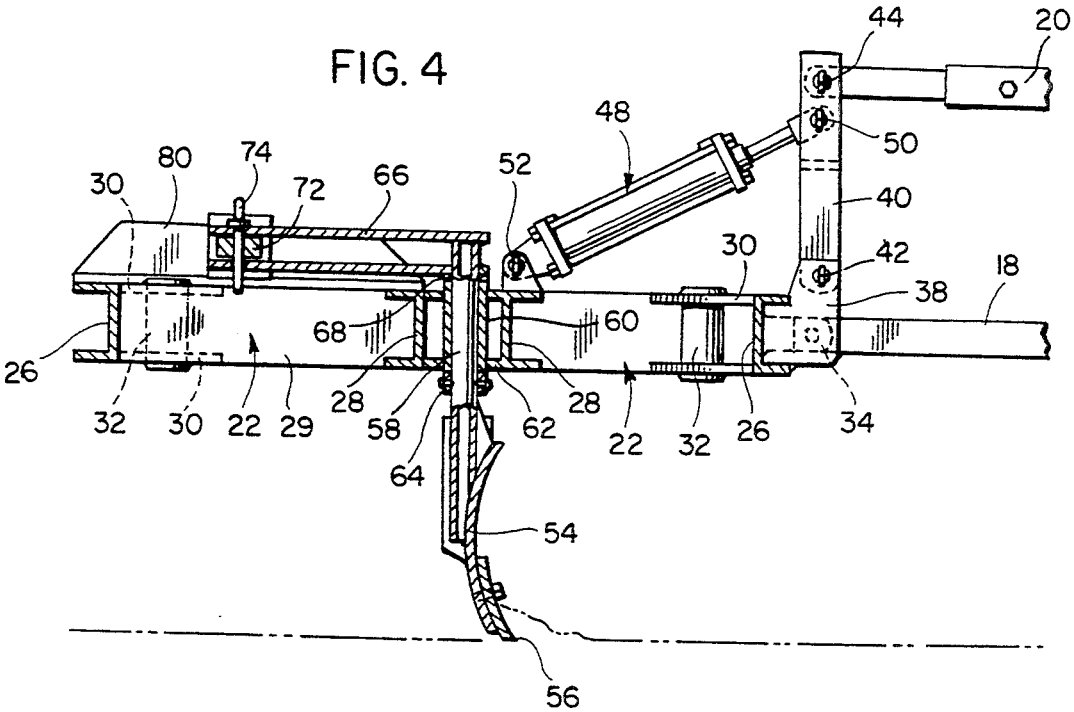
FIG. 4 is a longitudinal, sectional view taken along section line 4—4 on FIG. 2 illustrating further structural details of the pivotal support structure for the elongated blade.

A second embodiment of the invention is also illustrated in FIG. 1 in which a forwardly positioned wing blade 82 is positioned forwardly of the blade 54 with the wing blade 82 being relatively short and oriented in angular relation to the blade 54. The wing blade 82 includes a shaft or axle 84 of generally the same construction as the shaft or axle 58 for the blade 54 with the shaft or axle 84 extending through and being pivotally supported from a bearing sleeve extending between and rigidly affixed to the corner gusset plates 30 at one corner of the frame 22 as illustrated in FIGS. 1–3. The upper end of the shaft or axle 84 is connected to an offset arm 86 that is rigid therewith and the other end of the arm 86 is connected to a connecting link 88 by a pivot pin or bolt 90 with the other end of the link 88 being pivoted to lugs 92 by a pivot pin or bolt 94 with the lugs 92 being rigidly affixed by welding or the like to an intermediate portion of the arm 66 as illustrated in FIGS. 1 and 2. Thus, the blade 82 is pivoted about the axis of the shaft or axle 84 at the same time that the blade 54 is pivoted about the axis of the shaft or axle 58 when the ram 72 is expanded or contracted thereby providing an auxiliary wing blade 82 to assist in ditching, slope cutting and the like. The angular orientation of the blade 82 is varied about an axis perpendicular to the plane of the frame and the frame is varied as to angular attitude about a transverse axis as defined by the pivot pin or bolt 42 and the entire ditcher or slope cutting or forming device 10 can be vertically elevated or lowered by the three point hitch assembly.

It is clear from the above that only the blade 54 can be used or a combination of the blade 54 and 82 can be used or, in some instances, only the blade 82 may be used or the blade 54 may be used in conjunction with two forwardly positioned wing blades 82.

FIG. 5 illustrates an embodiment of the invention designated by references numeral 95 in which two forwardly disposed wing blades 96 and 98 are utilized without an elongated centrally disposed blade 54 with the blades 96 and 98 being identical to the blade 82 and being supported in the identical manner from the corner gussets 30. In this construction, the ram assembly 72 is utilized but the arm 66 is replaced with an elongated arm 100 that is journaled from the bearing sleeve 60 but does not support a blade 54 with one end of the arm 100 being connected to the piston rod 70 of the ram 72 and the other end connected to an elongated link or arm 102 by a pivot pin or bolt 104. The portion of the arm 100 between the piston rod 70 and the bearing sleeve 60 is provided with lugs 106 corresponding to lugs 92 in FIG. 1 with a link 108 connected thereto and connected to an offset arm 110 which corresponds with arm 86 in FIG. 1 in order to vary the angular position of the blade 96 about an axis perpendicular to the frame. The blade 98 is supported in a similar manner and is provided with an offset arm 112 that is connected to the end of the link or arm 102 by a pivot pin or bolt 114. This structure provides for simultaneous angular adjustment of both of the forwardly mounted blades 96 and 98 when the ram 72 is extended or retracted for varying the angular position of the blades 96 and 98 with respect to the frame and the frame can be adjusted about a transverse axis in the same manner as the structure illustrated in FIGS. 1–4 and the entire ditcher 12 may be varied upwardly and downwardly by actuating the three point hitch mechanism.

FIG. 6 illustrates another embodiment of the invention designated by reference numeral 115 in which the two front wing blades are identical to the arrangement illustrated in FIG. 5 and the same reference numerals are utilized. In this embodiment, two elongated blades 116 and 118 which may be the same length and construction as the blade 54 are supported from the rear corner gusset plates of the frame by a shaft or axle 120 extending through a bearing sleeve 32 between the gusset plates 30 with bolts or pins 122 securing the shaft or axle in place and enabling the blade 116 or blade 118 to pivot about an axis perpendicular to the plane of the frame. In order to adjust the angular position of the blades 116 and 118, each of the blades is connected to a hydraulic ram 124 having one end thereof pivotally connected to lugs 126 by a pivot pin or bolt 128 with the lugs being welded to the side frame members 24. The output piston 130 of the ram 124 is pivotally connected to the blade 116 by a pivot pin or bolt 132 engaged with lugs 134 welded to the blade 116 and the clevis 136 on the end of the piston rod 130. Thus, the blades 116 and 118 can be adjusted as to their angular position separately and independently of each other and separately and independently of the forward wing blades 96 and 98. As illustrated, the frame structure remains the same in all embodiments of the invention and the provision of the gussets, bearing sleeves and beams remain the same which enables selectively mounting any blade arrangement desired thereon including a single elongated blade, a forward wing blade at one or both corners, a rearward wing blade at one or both corners and single blades of any type at any corner and elongated blades at any or all corners. This provides a ditcher or sloping structure that can effectively perform various earth working operations. Also, while cutting blades are disclosed, the universal frame structure of this invention may be utilized with other earth working tools including scarifiers, plows, tillers, cultivators, discs and the like. Also, additional frame sections may be connected to either or both sides of the frame and attached thereto in a manner to enable them to be pivoted upwardly and inwardly to a folded or collapsed condition for ease of transport. Further, tandemly towel attachments of various types may be connected to the frame 22 by using the lug 53 at the rear center of the frame. It is pointed out that while hydraulic rams have been disclosed to adjust the components of the ditcher, mechanical adjustment means may be provided to adjust the components with either type of adjustment means being manually or remotely operated.

The device is effectively used for ditching roads, working roads, streets and highways, forming shoulders, road building and various farm work. The device may also be effectively used for forming terraces and levees by rice and soybean farmers and for various other farming operations with the elongated blades enabling levees to be effectively formed up to a height of about eight feet. When the wing blades are used in combination with the elongated blades, the wing blades will cut or clean a ditch and transfer the material up to the shoulder of a road with the elongated blade then carrying the material further out into the roadway and spreading it all in one process thereby saving an extra trip which will save time and money. The functional utility of the device is unlimited and enables an owner of the device to perform various earth working operations at a minimum of cost since the relatively simple and adaptable ditcher of this invention eliminates the need for purchasing expensive specialized earth working apparatuses.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A ditcher adapted to be connected to a three point hitch of a tractor by which the ditcher can be towed and adjusted in elevational position, said ditcher including a rigid frame, means at a forward portion of the frame for connection with a three point hitch, an elongated earth working blade positioned below the frame and extending at least partially transversely thereof, means mounting the earth working blade from the frame for pivotal movement in relation to the hitch about a generally vertical axis perpendicular to the frame, means interconnecting the frame and earth working blade to pivot the earth working blade about the generally vertical mounting axis of said earth working blade, said frame having a substantial longitudinal extent, means pivotally supporting a forward portion of the frame from the three point hitch for pivotal movement about a generally horizontal transverse axis, and means interconnecting the three point hitch and the frame at a point rearwardly of the forward portion of the frame to pivot the frame about said transverse axis located at the forward portion of the frame to pivot the frame about said transverse axis independently of said hitch and said means interconnecting the frame and blade for pivoting the blade about the mounting axis of the earth working blade in relation to a ground surface to be engaged by the earth working blade, said means mounting the earth working blade from the frame including an upwardly extending shaft rigid with a mid-portion of said blade, said frame including a bearing sleeve perpendicular to the frame receiving said shaft, said means interconnecting the frame and the earth working blade including adjustment means connected to said frame and said shaft, said adjustment means connected to said frame and said shaft including a laterally extending arm connected with said shaft and power means connected to said frame add an outer end of said arm for pivoting the blade about a longitudinal axis of said shaft, said frame being substantially square and formed with beams in a single plane, each inside corner of said frame including a bearing sleeve, and a wing blade pivotally supported from a bearing sleeve on the frame for pivotal movement about an axis perpendicular to the plane of the frame, a laterally extending arm connected with the wing blade and linkage means interconnecting the arm on the wing blade and the arm on the elongated blade shaft for pivoting the wing blade simultaneously with the elongated blade.

2. The ditcher as defined in claim 1 together with an additional wing blade pivotally supported from another bearing sleeve on the frame for pivotal movement about an axis perpendicular to the plane of the frame, a laterally extending arm connected with the additional wing blade, and linkage means interconnecting the arm on the additional wing blade and the arm on the elongated blade shaft for simultaneously moving both wing blades simultaneously with the elongated blade.

3. An earth working device comprising a generally rectangular frame constructed of rigidly connected frame members oriented in substantially a single plane, means at a forward portion of said frame for connection to a towing vehicle having a hitch assembly enabling the frame to be varied in elevational position in relation to a ground surface to be worked, adjustment means interconnecting said frame and hitch assembly and connected to said frame rearwardly by said forward portion for pivoting the frame about a transverse, generally horizontally disposed axis at a forward portion of the frame to vary the angular relation between the frame and the ground surface to be worked, an elongated earth working blade oriented below said frame, said elongated earth working blade oriented transversely of the path of movement of the frame, means pivotally supporting said elongated earth working blade from said frame for pivotal movement about an axis generally perpendicular to the frame and perpendicular to the transverse axis at the forward portion of said frame, and adjustment means moving said elongated earth working blade about the axis of support of said earth working blade from the frame to adjust the elongated earth working blade in relation to the frame about the axis of pivotal movement of the earth working implement on the frame to orient the earth working implement in different relationships to the surface to be worked, said hitch assembly adjusting he elevational position of the frame, said adjustment means interconnecting the frame and hitch assembly adjusting the frame about a transverse axis, said adjustment means moving said elongated earth working blade adjusting the elongated earth working blade about an axis perpendicular to the plane of the frame, said hitch assembly and each of said adjustment means being independently actuated, said frame being provided with at least one additional earth working blade which includes a pivotal connection with said frame for pivotal movement about an axis perpendicular to said frame and means pivoting said additional earth working blade in relation to said frame for performing various earth working operations, said means pivoting the additional earth working blade including linkage means connected to said adjustment means moving said elongated earth working blade about the axis of support of said elongated earth working blade for simultaneously adjusting said earth working blades about axes perpendicular to the frame.

4. An earth working device comprising a generally rectangular frame constructed of rigidly connected frame members oriented in substantially a single plane, means at a forward portion of said frame for connection to a towing vehicle having a hitch assembly enabling the frame to be varied in elevational position in relation to a ground surface to be worked, adjustment means interconnecting said frame and hitch assembly and connected to said frame rearwardly of said forward portion for pivoting the frame about a transverse, generally horizontally disposed axis at a forward portion of the frame to vary the angular relation between the frame and the ground surface to be worked, said frame including means at each corner thereof for supporting an earth working blade for pivotal movement about an axis generally vertically disposed and perpendicular to said frame, power means interconnecting said frame and said earth working blades adjacent the corners at a forward portion of said frame for simultaneous pivotal movement of the earth working blades at the corners of the frame at the forward portion of the frame, independent power means interconnecting said frame and each of the earth working blades at a rearward portion of the frame for pivoting the earth working blades at a rearward portion of the frame independent of each other and independent from pivotal movement of the earth working blades at the corners of the frame at the forward portion of the frame.

* * * * *